US005598952A

United States Patent [19]

Daansen

[11] Patent Number: 5,598,952

[45] Date of Patent: Feb. 4, 1997

[54] SOAP BOX FOR A SOAP DISPENSER

[76] Inventor: Warren S. Daansen, P.O. Box 614, Nashua, N.H. 03061

[21] Appl. No.: 560,377

[22] Filed: Nov. 17, 1995

[51] Int. Cl.[6] ..... B67D 5/06

[52] U.S. Cl. ..... 222/105; 222/183

[58] Field of Search ..... 222/105, 181.3, 222/183, 207, 214, 325

[56] References Cited

U.S. PATENT DOCUMENTS

| | | | |
|---|---|---|---|
| 3,843,021 | 10/1974 | Schieser | 222/105 |
| 4,130,224 | 12/1978 | Norman et al. | 222/207 X |
| 4,621,749 | 11/1986 | Kanfer | 222/183 X |
| 4,667,854 | 5/1987 | McDermott et al. | 222/105 X |
| 4,895,276 | 1/1990 | Maldonado | 222/214 X |
| 5,265,772 | 11/1993 | Bartasevich et al. | 222/214 |
| 5,379,917 | 1/1995 | Brown et al. | 222/105 X |
| 5,464,125 | 11/1995 | Daansen | 222/214 X |
| 5,501,372 | 3/1996 | Daansen | 222/207 |

*Primary Examiner*—Kevin P. Shaver
*Attorney, Agent, or Firm*—Vernon C. Maine

[57] ABSTRACT

A box-in-a-bag liquid soap container system for use in a soap dispenser where the container cavity has hinge point structure and sidewall strakes that interfere with the use of the full volume of the container cavity. The invention consists of a box sized to fit the full dimensions of the container cavity, with a collapsible plastic bag of liquid soap inside, where the lower front corners of the box are perforated and removable so as to provide clearance for the intruding hinge point structure, and strips of the sidewalls and back wall of the box are perforated and removable to provide clearance for the sidewall strakes. The box, with the perforations torn out fits the full size of the container cavity, and the bag conforms to the intruding hinge point structure and sidewall strakes, thus significantly increasing the liquid capacity over prior art containers sized to fit between the strakes.

3 Claims, 8 Drawing Sheets

SOAP BOX FOR A SOAP DISPENSER

BACKGROUND OF THE INVENTION

1. Technical Field of the Invention

This invention most generally relates to soap dispensers, and more particularly to disposable soap containers used in soap dispensers.

2. Background Art

The art of provisioning restrooms with liquid soap in such quantities as to provide a useful servicing interval, with the convenience of metered dispensing and disposable containers, has led to many solutions.

One is the use of disposable, integrated container/pump systems such as plastic bottles with pumps incorporated into their caps, which are disposed of when empty and replaced with all new units, or simply opened and refilled from a bulk source such as a larger bottle or container.

Another one is the use of wall-mounted dispensers which provide a greater degree of security and reliability for public-use and business-use restrooms. This type of unit is typically stocked by means of inserting a disposable, container of liquid soap into a cavity sized for the purpose within the upper region of the dispenser. This discussion proceeds in the context of this type of dispenser.

The soap container used in this type of dispenser is commonly comprised of a collapsible plastic bag inside a formed paperboard box, where the box is matched to the size of dispenser's container cavity. As supplied, the bag is filled with soap to the extent that it conforms to the interior dimensions of the box. The system is sometimes referred to as a bag-in-a-box. The uniform shape of the box is convenient for shipping and storage, and provides form to the heavy, full bag when it is placed in a dispenser cavity which might not otherwise provide adequate support to the collapsible bag alone.

A pump tube is attached to the bottom of the bag and engaged in the dispenser mechanism. The liquid soap is passed in metered amounts through this tube and expelled into the user's palm by activation of a push or pull lever which squeezes the tube against a backplate. The bag is airtight, so that as the soap is drawn from the bag, it gradually collapses within the box into a small knot of plastic.

The dispenser may be equipped with a small window in the cover looking into the soap container cavity. The box is typically supplied with a perforated slot on the front side, the slot covering material of which is removed at the time of insertion into the dispenser, allowing the tube to be extended downward into the dispenser mechanism, and the plastic bag to be viewed through the window when the dispenser is closed.

When the bag is totally or nearly depleted, as may be observed through the window, the dispenser is due to be serviced. This simply entails opening the dispenser, removing the empty container and installing a new one.

Dispenser cavities are generally designed to accept a specific, maximum size box, which defines the maximum volume or capacity of soap that the dispenser can hold. 500, 1000, and 1200 milliliter are some of the common sizes.

Occasionally in the course of design evolution, a dispenser design is modified in some fashion to gain an additional benefit such as a larger cavity which will accept a larger box of soap, thus providing the user with greater capacity per dispenser. When a given design change is released to production, several thousands of that design are likely to be produced and placed into permanent use in the industry before another design change is made.

Once installed, any shortcomings of a particular design not seriously affecting or fatal to its continuing use are generally tolerated by the user, as long as soap is supplied in compatible containers at reasonable prices.

Referring here to the prior art FIGS. 1—5, in one instance a manufacturer produced a variation of an earlier design which resulted in a dispenser cavity that is not optimal. Hinge structure on the inside of the cover plate of the dispenser closes into the lower front corners of the cavity volume, space otherwise available for a box of the same width and depth as the cavity, thereby restricting the maximum box and bag size that may be used in this dispenser.

In order to properly position a sufficiently narrow 1000 ml box-in-a-bag container in the remaining space available and to hold the box centered over the pump recess in the lower portion of the dispenser, the manufacturer modified the cavity by adding horizontal strakes to both sidewalls.

The problem with this design compromise is that several thousands of these dispensers have been installed over the years, all restricted to using the narrow 1000 ml box. Newer dispenser designs of the same general size as the subject prior art dispenser, can utilize 1200 ml containers. The ability to utilize larger soap containers without having to purchase and install new dispensers would provide a valuable service to these users. Neither the manufacturer nor the industry has offered a viable solution thus far.

SUMMARY OF THE INVENTION

The invention in it's simplest form is a box-in-a-bag soap container system for a specific prior art dispenser, wherein the box of the container system has been sized to fit the maximum dimensions of the container cavity, and modified to provide room for dispenser structure that intrudes into the otherwise uniform volume of the container cavity. The bag of liquid soap is allowed to contact the intruding structures through openings in the box made by the user at the time of installation into the dispenser.

The bag is constructed of material of sufficient strength and flexibility that the bag wall may be depended upon to conform to the presence of the dispenser structure intruding into the openings of the box, while the remainder of the box structure provides the requisite support to hold the full bag of liquid soap in the proper position within the dispenser cavity.

It is an object of the invention to provide a box-in-a-bag container system with the maximum capacity suitable for an existing dispenser which has a container cavity with permanent sidewall strakes which intrude into the otherwise uniform maximum width dimension of the cavity.

To this end, the box of the bag-in-a-box container has means for removing box wall material in the area that would otherwise cause interference with the sidewall strakes in the container cavity, and the bag wall is of sufficient strength and flexibility to conform to and accommodate the intruding strakes as the container is inserted into the dispenser cavity.

It is another object of the invention to provide a box-in-a-bag container system with the maximum capacity suitable for an existing dispenser which has hinge point structure in the dispenser cover to which a push bar is attached, which structure intrudes into the lower front corners of the container cavity when the cover is moved into a closed position over the dispenser.

To this end, the box of the bag-in-a-box container has means for removing box wall material in the area that would otherwise cause interference with the hinge point structure of the cover when closed, and the bag wall is of sufficient strength and flexibility to conform to and accommodate the intruding structure when the cover is closed thereon.

It is yet another object to provide such a box-in-a-bag in a fully-closed form for shipping and storage, in order to protect the bag therein. To that end, the box may be fabricated of paperboard or similar material, with precut perforations or tear lines so that the necessary openings can be made in the otherwise closed box at the time of installation.

It is still yet another object to provide a box-in-a-bag container of liquid soap for an existing dispenser which has a container cavity with permanent sidewall strakes which intrude into the otherwise uniform maximum width dimension of the cavity, and hinge point structure in the dispenser cover to which a push bar is attached, which structure intrudes into the lower front corners of the container cavity when the cover is moved into a closed position over the dispenser, in a 1200 or larger milliliter size.

Still other objects and advantages of the present invention will become readily apparent to those skilled in this art from the following detailed description, wherein I have shown and described preferred and other embodiments of the invention, simply by way of illustration of the best mode contemplated by me on carrying out my invention.

As will be realized, the invention is capable of other and different embodiments, and its several details are capable of modifications in various obvious respects, all without departing from the invention.

DESCRIPTION OF THE PREFERRED EMBODIMENT

There are numerous possible variations in the form of the invention, such as are illustrated and described herein, which fall within the scope of the appended claims.

For example, a box-in-a-bag liquid soap container for use in a soap dispenser that has a container cavity with intruding left and right sidewall strakes and intruding hinge point structure at the lower front corners when the cover is closed, consists of a box large enough to fit the full dimensions of the container cavity.

The box has a collapsible plastic bag inside, full of liquid soap. The lower front corners of the box are removable so as to provide clearance for the hinge point structure of the cover, and portions of the sidewalls and back wall of the box are removable so as to provide clearance for the left and right sidewall strakes. The bag is readily conformable to the presence of the hinge point structure and the strakes.

As another example, the box-in-a-bag liquid soap container for use in a soap dispenser having a container cavity with intruding left and right sidewall strakes and intruding hinge point structure at the lower front corners, consists of a paperboard box sized to fit the full dimensions of the container cavity.

The box has a collapsible plastic bag inside, with a pump tube depending from the bag. The lower front corners of the box are removable by tearing or cutting along cut lines or precut perforations so as to provide clearance openings for the hinge point structure. Portions of the sidewalls and back wall of the box are also removable tearing or cutting along cut lines or precut perforations so as to provide clearance openings for the left and right sidewall strakes.

The bag is readily conformable to the presence of the hinge point structure and the strakes when the container is inserted into the dispenser and the cover is closed.

As yet another example, the container is sized to hold 1200 milliliters of liquid soap.

Figure 1:
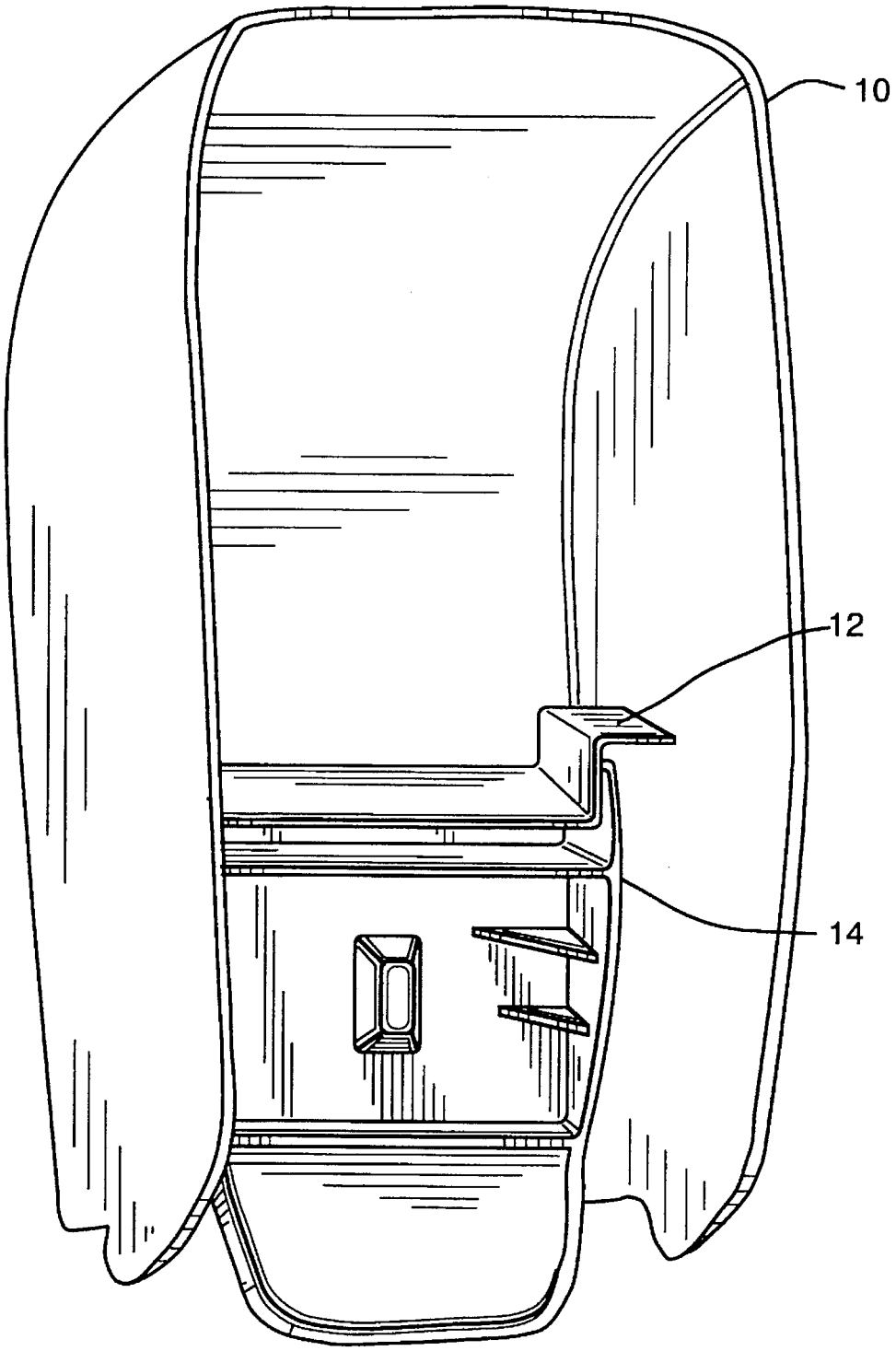
FIG. 1 (PRIOR ART)
FIG. 1 is a backside interior perspective of a prior art dispenser cover.

Referring first to the prior art FIGS. 1–5:

FIG. 1 shows the interior of dispenser cover 10 with hinge point structure 12 to which push bar 14 is attached.

Figure 2:
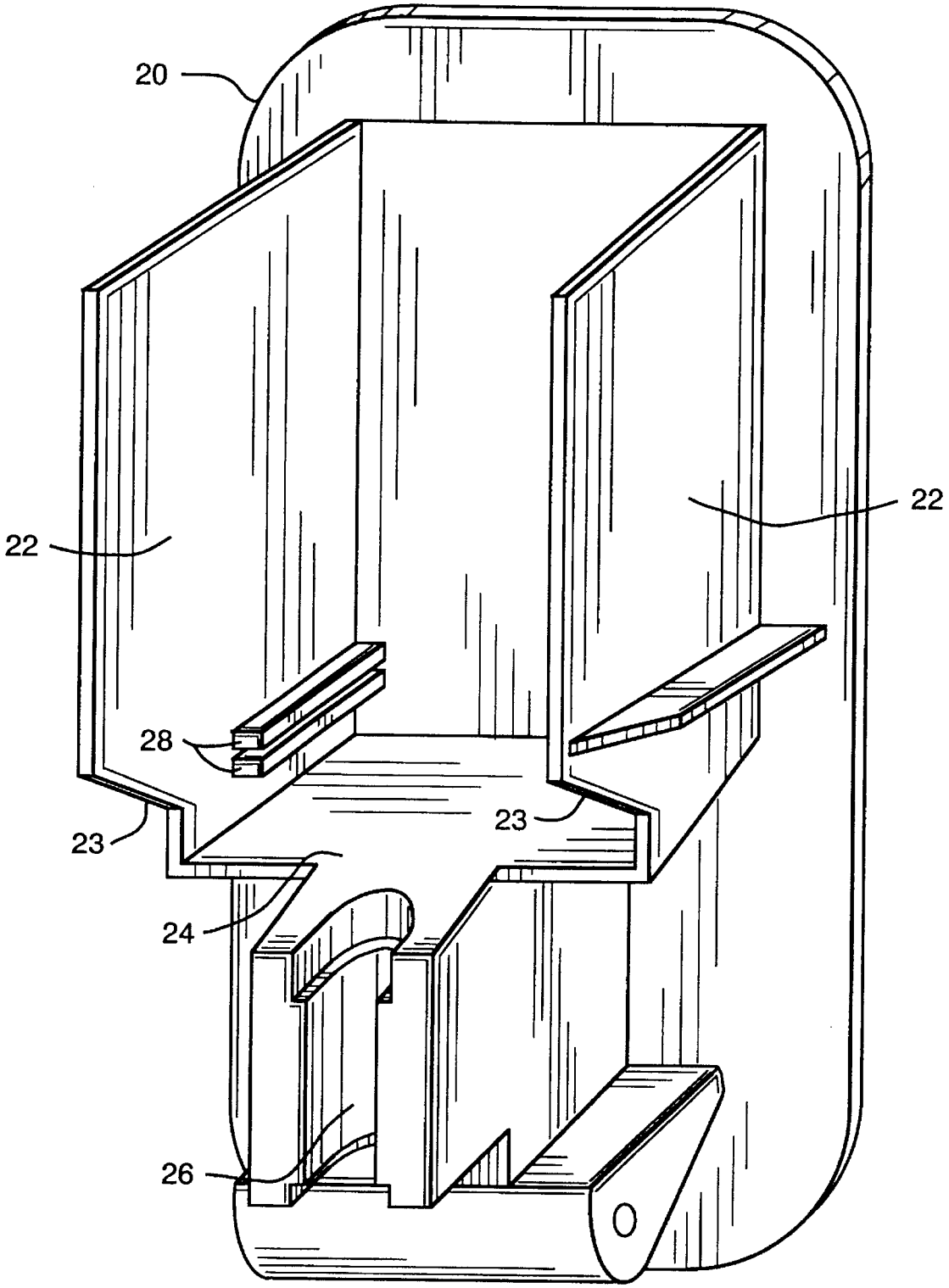
FIG. 2 (PRIOR ART)
FIG. 2 is a right front perspective of a prior art dispenser with the cover removed.

FIG. 2 is a perspective view of dispenser 20 with cover 10 removed, showing the cavity defined by sidewalls 22 and horizontal support surface 24, into which a soap container is placed, and the recess 26 into which a pump tube is positioned. The sidewall strakes 28 are visible on one wall of the cavity. Notches 23 in the lower front corners of sidewalls 22 are evident, and necessary for clearance of hinge point structure 12 when cover 10 is in place.

Figure 3A:
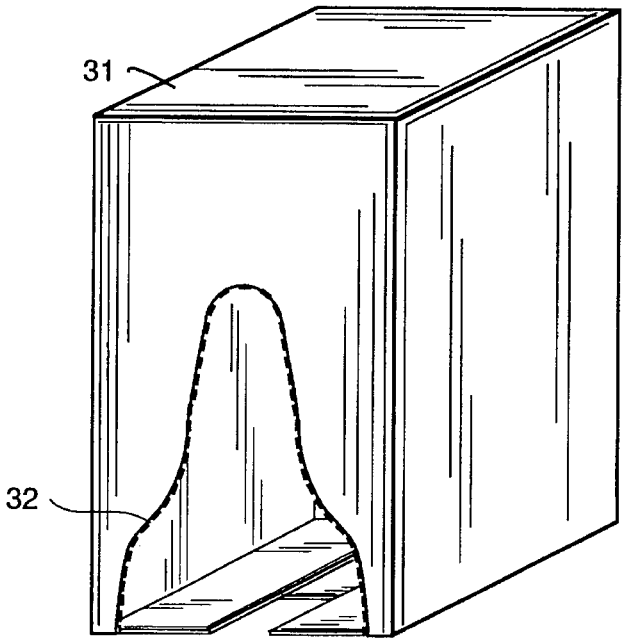
FIG. 3A (PRIOR ART)
FIGS. 3A and 3B is a perspective drawing of a prior art box and bag-in-a-box container of liquid soap.
Figure 3B:
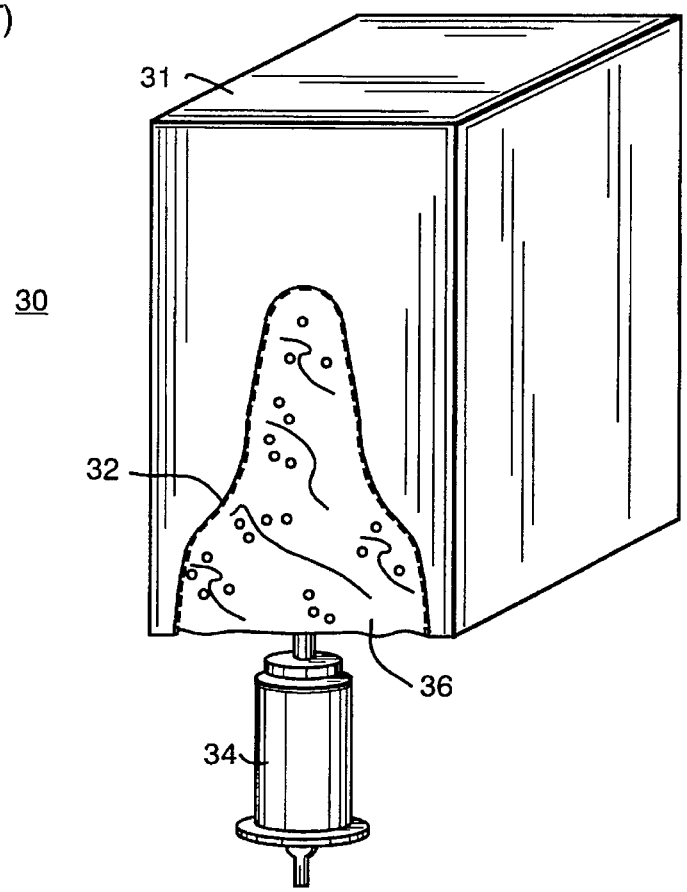
FIG. 3B (PRIOR ART)

FIG. 3 is a two-part drawing of a prior art 1000 milliliter bag-in-a-box container 30, FIG. 3A showing box 31 with perforated slot 32 having been torn open, and FIG. 3B showing box 31 with pump tube 34 and bag 36 full of liquid soap; the box again with slot 32 open, pump tube 34 having been pulled out and extending downward as it would be prior to installation into dispenser 20.

Figure 4:
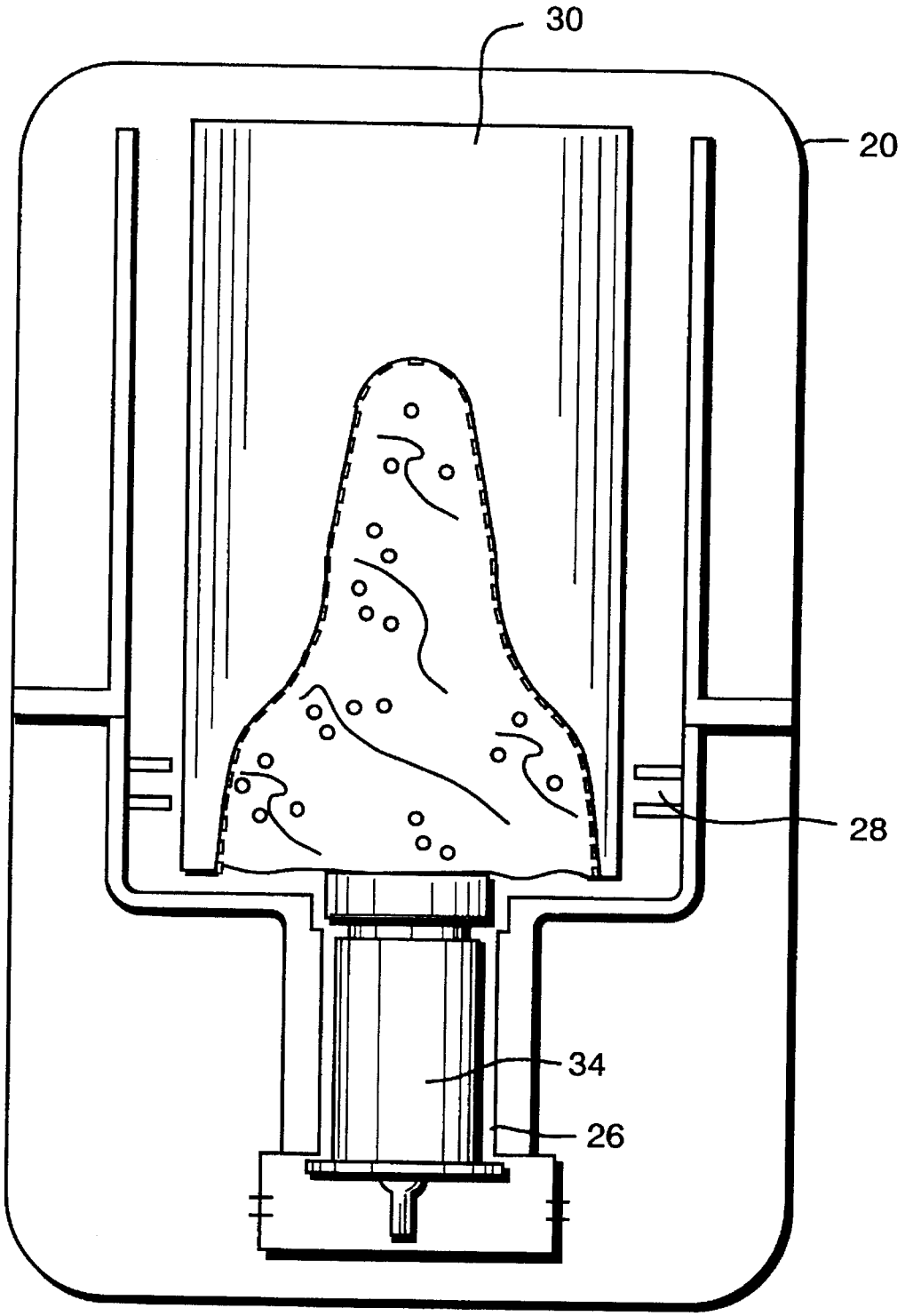
FIG. 4 (PRIOR ART)
FIG. 4 is a front elevation of the container of FIG. 3 installed in the dispenser of FIG. 2.

FIG. 4 shows the prior art container 30 of FIG. 3 as actually installed in dispenser 20 of FIG. 2, being held in a centered position by sidewall strakes 28, with pump tube 34 located in recess 26.

Figure 5:
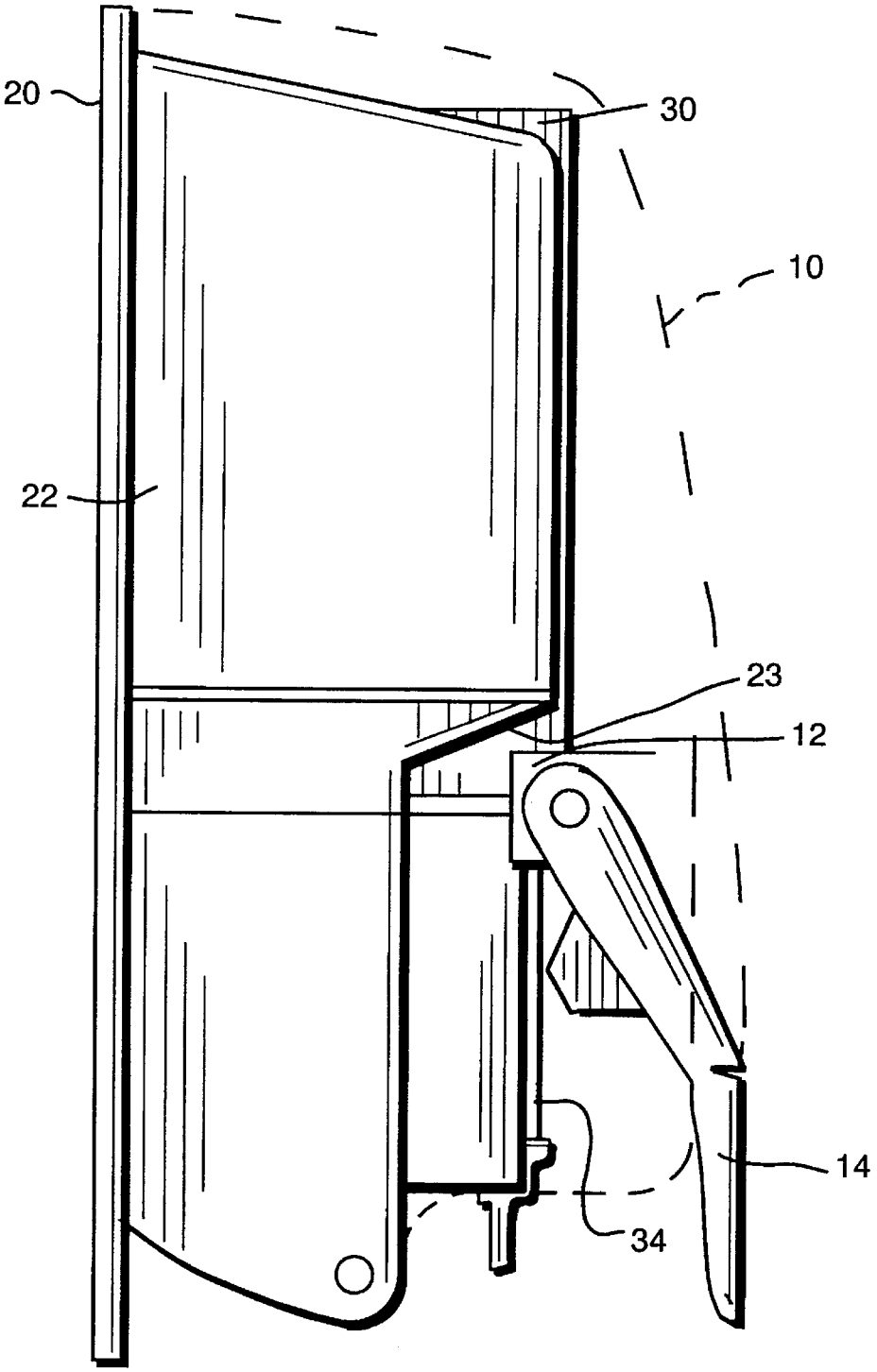
FIG. 5 (PRIOR ART)
FIG. 5 is a side elevation of the dispenser of FIG. 2 with the cover outline and hinge point structure of FIG. 1 superimposed thereon.

FIG. 5 shows a side view with cover 10 as a dashed outline superimposed over dispenser 20, with hinge point structure clearly intruding into the corners of the container cavity on either side of the centered box 31 of prior art container 30.

Figure 6:
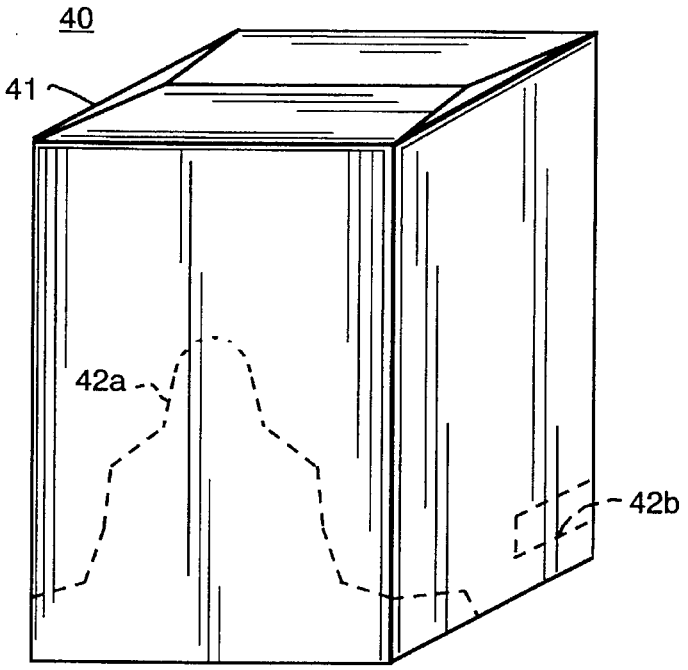
FIG. 6 is an upper right front perspective of the box of the invention.

Referring now to FIGS. 6–10 of the invention:

FIG. 6 shows a perspective view of the 1200 milliliter box 41 of container 40 of the invention, with perforations 42A extending to the lower front corners to accommodate hinge point structure 12 of prior art dispenser cover 10 and perforations 42B properly located on the right side of box 41 to accommodate right sidewall strakes 28 of prior art dispenser 20, the perforations as yet closed for shipment and storage with bag 46 of liquid soap and attached pump tube 44 contained within.

Figure 7:
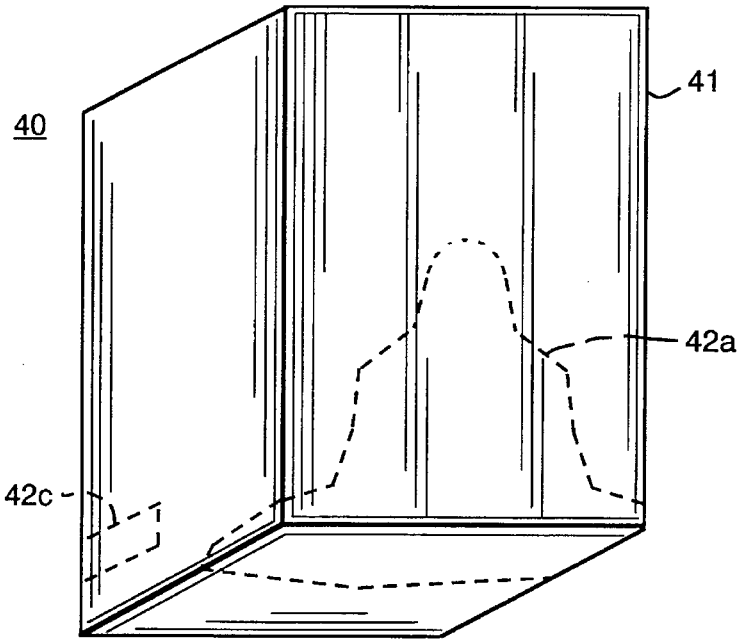
FIG. 7 is a lower left front perspective of the box of the invention.

FIG. 7 shows a lower left front perspective view of box 41 of the invention revealing the balance of the outline of front side perforations 42A and left side perforations 42C.

Figure 8:
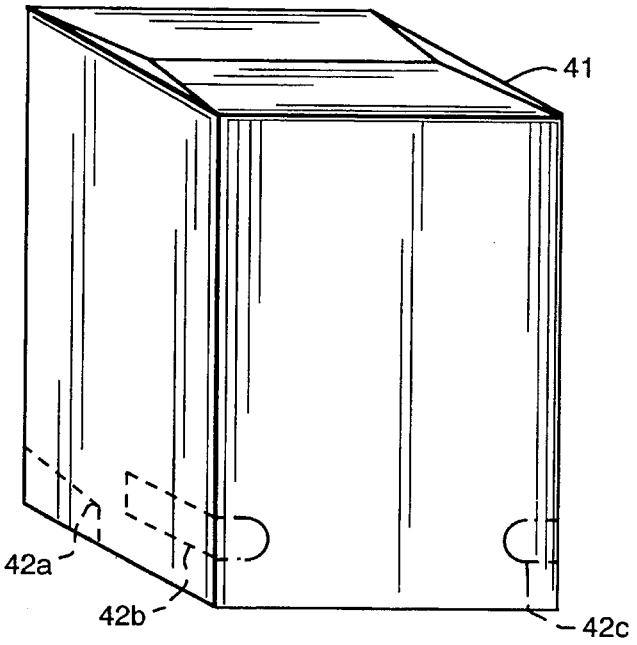
FIG. 8 is a backside perspective of the box of the invention.

FIG. 8 shows a rear side perspective view of box 41 of the invention, showing the balance of the sidewall perforations 42B and 42C.

Figure 9:
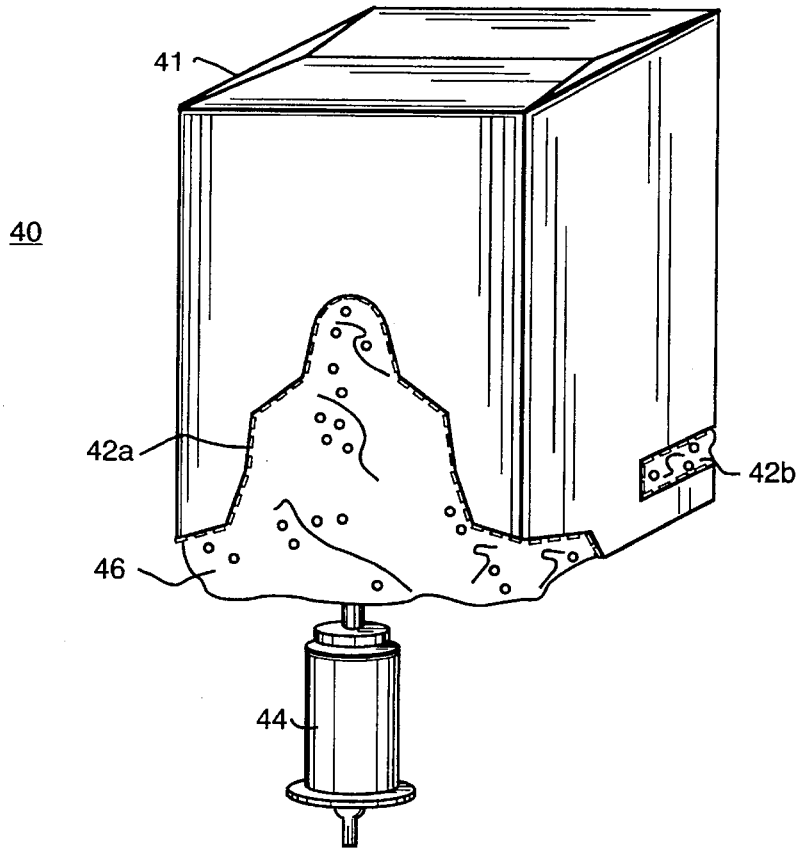
FIG. 9 is a front perspective of the box and bag of the invention with the perforations having been torn out.

FIG. 9 shows box 41 and bag 46 of the invention with perforations 42A, 42B and 42C having been torn out to provide room for hinge point structure 12 of prior art cover 10 and sidewall strakes 28 of the prior art dispenser 20.

Figure 10:
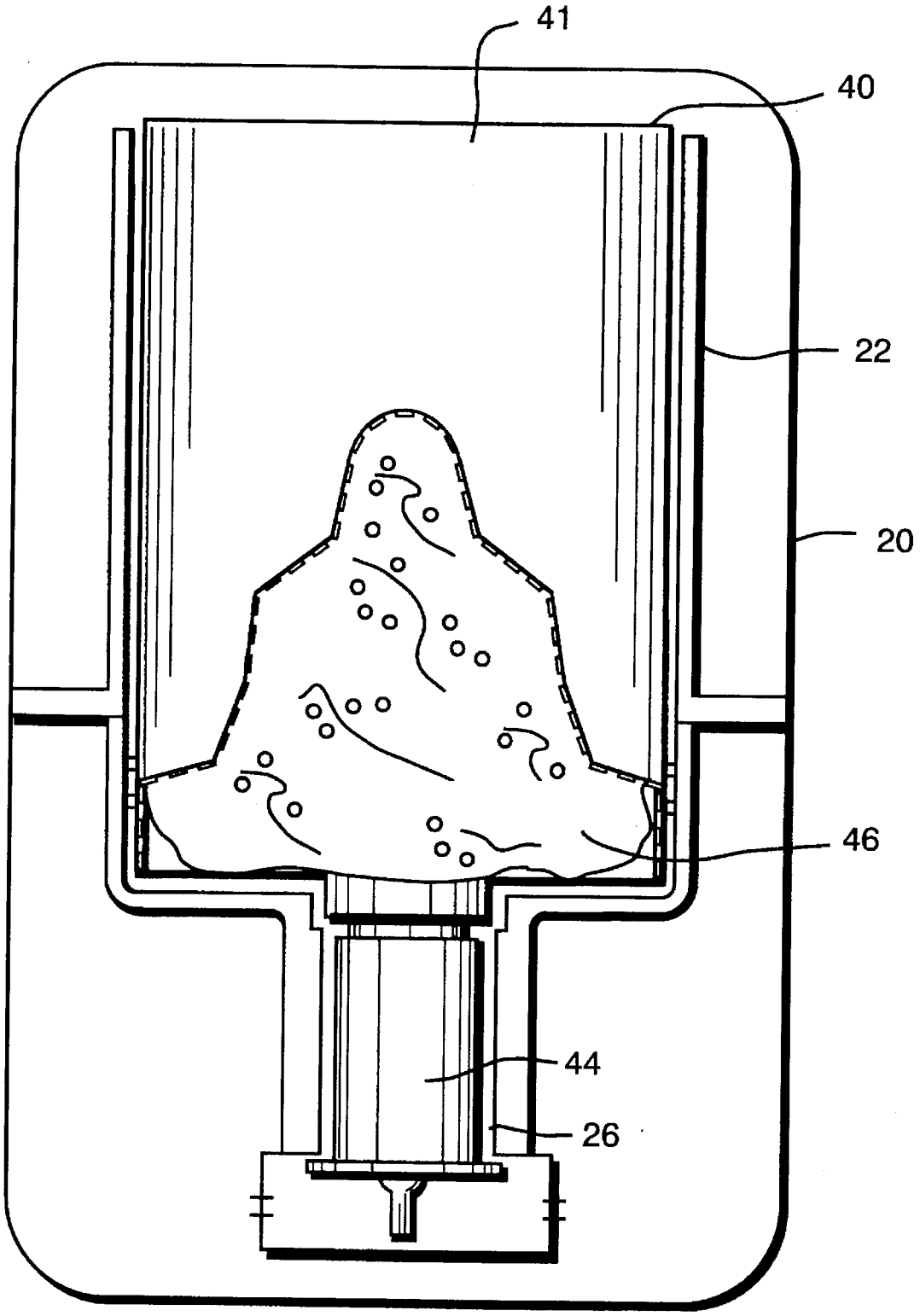
FIG. 10 is a front elevation of the box and bag of FIG. 9 installed in the prior art dispenser of FIG. 2.

FIG. 10 shows box 41 and bag 46 installed in prior art dispenser 20, box 41 substantially filling the cavity between sidewalls 22. The openings provided by perforations 42B and C in box 41, with the flexibility of bag 46, accommodate the intruding structure of sidewall strakes 28, and the absent lower front corners of box 41, provided by perforations 42A, with the flexibility of bag 46, accommodate the intrusion of hinge point structure 12 when prior art cover 10 is in place.

The objects and advantages of the invention may be further realized and attained by means of the instrumentalities and combinations particularly pointed out in the appended claims. Accordingly, the drawings and description are to be regarded as illustrative in nature, and not as restrictive.

I claim:

1. A box-in-a-bag liquid soap container for use in a soap dispenser having a container cavity with intruding left and right sidewall strakes and intruding hinge point structure at the lower front corners, comprising a box sized to fit the full dimensions of said container cavity, said box having a collapsible plastic bag therein, said lower front corners of said box being removable so as to provide clearance for said hinge point structure, portions of the sidewalls and back wall of said box being removable so as to provide clearance for said left and right sidewall strakes, and said bag being readily conformable to the presence of said hinge point structure and said strakes.

2. A box-in-a-bag liquid soap container for use in a soap dispenser having a container cavity with intruding left and right sidewall strakes and intruding hinge point structure at the lower front corners, comprising a paperboard box sized to fit the full dimensions of said container cavity, said box having a collapsible plastic bag therein with a pump tube depending therefrom, said lower front corners of said box being removable by means of tearable perforations so as to provide clearance for said hinge point structure, portions of the sidewalls and back wall of said box being removable by means of tearable perforations so as to provide clearance for said left and right sidewall strakes, and said bag being readily conformable to the presence of said hinge point structure and said strakes when said container is inserted into said dispenser and enclosed therein.

3. The container of claim 2, said box and said bag sized to hold 1200 milliliters of liquid soap.

* * * * *

UNITED STATES PATENT AND TRADEMARK OFFICE

CERTIFICATE OF CORRECTION

PATENT NO. : 5,598,952

DATED : Feb. 4, 1997

INVENTOR(S) : Daansen

It is certified that error appears in the above-indentified patent and that said Letters Patent is hereby corrected as shown below:

Abstract - line 1, change 'box-in-a-bag' to 'bag-in-a-box' col. 2, line 17, change 'box-in-a-bag' to 'bag-in-a-box' col. 2, line 33, change 'box-in-a-bag' to 'bag-in-a-box' col. 2, line 49, change 'box-in-a-bag' to 'bag-in-a-box' col. 2, line 60, change 'box-in-a-bag' to 'bag-in-a-box' col. 3, line 7, change 'box-in-a-bag' to 'bag-in-a-box' col. 3, line 14, change 'box-in-a-bag' to 'bag-in-a-box'

UNITED STATES PATENT AND TRADEMARK OFFICE

CERTIFICATE OF CORRECTION

PATENT NO. : 5,598,952
DATED : Feb. 4, 1997
INVENTOR(S) : Daansen

It is certified that error appears in the above-indentified patent and that said Letters Patent is hereby corrected as shown below:

col. 4, line 1, change 'box-in-a-bag' to 'bag-in-a-box' col. 4, line 14, change 'box-in-a-bag' to 'bag-in-a-box'

Claim 1, line 1, (col. 6, line 2), change 'box-in-a-bag' to 'bag-in-a-box'

Claim 2, line 1, (col. 6, line 14), change 'box-in-a-bag' to 'bag-in-a-box'

Signed and Sealed this
Ninth Day of September, 1997

Bruce Lehman

*Attest:*

BRUCE LEHMAN

*Attesting Officer*

*Commissioner of Patents and Trademarks*